US008847051B2

(12) United States Patent
Hanks

(10) Patent No.: US 8,847,051 B2
(45) Date of Patent: Sep. 30, 2014

(54) KEYBOARD GUITAR INCLUDING TRANSPOSE BUTTONS TO CONTROL TUNING

(71) Applicant: Michael S. Hanks, Centralia, IL (US)

(72) Inventor: Michael S. Hanks, Centralia, IL (US)

( * ) Notice: Subject to any disclaimer, the term of this patent is extended or adjusted under 35 U.S.C. 154(b) by 12 days.

(21) Appl. No.: 13/844,630

(22) Filed: Mar. 15, 2013

(65) Prior Publication Data

US 2013/0255474 A1 Oct. 3, 2013

Related U.S. Application Data

(60) Provisional application No. 61/616,610, filed on Mar. 28, 2012.

(51) Int. Cl.

| | |
|---|---|
| ***G10C 3/12*** | (2006.01) |
| ***G10H 1/00*** | (2006.01) |
| ***G10H 1/34*** | (2006.01) |

(52) U.S. Cl.

CPC ..... *G10H 1/342* (2013.01); *G10H 2220/051* (2013.01); *G10H 1/0016* (2013.01)

USPC ..... 84/423 R

(58) Field of Classification Search

CPC ..... G10H 1/342

USPC ..... 84/423 R

See application file for complete search history.

(56) References Cited

U.S. PATENT DOCUMENTS

| | | | | | |
|---|---|---|---|---|---|
| 2,192,077 | A | * | 2/1940 | Hanson, Jr. | 84/447 |
| 3,023,659 | A | * | 3/1962 | Bode | 84/445 |
| 3,541,912 | A | * | 11/1970 | Radke | 84/715 |
| 3,555,166 | A | * | 1/1971 | Gasser | 84/600 |
| D220,650 | S | * | 5/1971 | Poznanovich | D17/1 |
| 3,610,800 | A | * | 10/1971 | Deutsch | 84/619 |
| 3,674,907 | A | * | 7/1972 | Derry | 84/685 |
| 3,971,282 | A | * | 7/1976 | Obayashi et al. | 84/685 |
| D245,197 | S | * | 7/1977 | Noury, Jr. | D17/1 |
| 4,078,464 | A | * | 3/1978 | Sugiyama | 84/744 |
| D254,496 | S | * | 3/1980 | Hill | D17/1 |
| D256,366 | S | * | 8/1980 | Dworsky | D17/1 |
| 4,332,182 | A | * | 6/1982 | Franz et al. | 84/648 |
| 4,339,979 | A | * | 7/1982 | Norman | 84/627 |
| RE31,019 | E | * | 8/1982 | Evangelista | 84/702 |
| D278,066 | S | * | 3/1985 | Garoogian | D17/1 |
| D278,154 | S | * | 3/1985 | Baker | D17/9 |
| 4,570,521 | A | * | 2/1986 | Fox | 84/653 |
| D296,338 | S | * | 6/1988 | Sgroi | D17/1 |
| 4,794,838 | A | * | 1/1989 | Corrigau, III | 84/600 |
| D310,090 | S | * | 8/1990 | Stone et al. | D17/2 |
| 4,974,486 | A | * | 12/1990 | Wallace | 84/609 |
| 5,113,742 | A | * | 5/1992 | Matsumoto | 84/615 |
| 5,121,668 | A | * | 6/1992 | Segan et al. | 84/646 |
| D349,127 | S | * | 7/1994 | Nelson | D17/1 |
| 6,111,179 | A | * | 8/2000 | Miller | 84/442 |

(Continued)

*Primary Examiner* — Robert W Horn

(74) *Attorney, Agent, or Firm* — Richards Patent Law P.C.

(57) ABSTRACT

A musical instrument includes: a body including a keybed having a plurality of keys, wherein activation of each key creates an electrical signal at an output, wherein said electrical signal represents a pitch associated with a musical note; an elongated neck connected to the body; and a plurality of transpose buttons located along the length of the neck, wherein the transpose buttons of the fretboard are configured to control the tuning of the keys in the keybed such that activation of each of the transpose button alters the pitch represented by the electrical signal that is output by of each of the keys.

6 Claims, 2 Drawing Sheets

(56) References Cited

U.S. PATENT DOCUMENTS

| | | | | |
|---|---|---|---|---|
| 6,777,608 | B1 * | 8/2004 | Redding | 84/746 |
| 7,044,857 | B1 * | 5/2006 | Klitsner et al. | 463/35 |
| D549,766 | S * | 8/2007 | Greenberg | D17/2 |
| 7,396,987 | B1 * | 7/2008 | Tentindo | 84/423 R |
| 7,928,312 | B2 * | 4/2011 | Sharma | 84/719 |
| 8,426,719 | B2 * | 4/2013 | Shim | 84/743 |
| 2013/0255474 | A1 * | 10/2013 | Hanks | 84/615 |

* cited by examiner

KEYBOARD GUITAR INCLUDING TRANSPOSE BUTTONS TO CONTROL TUNING

BACKGROUND OF THE INVENTION

The present subject matter relates generally to an improved keyboard guitar or keytar. More specifically, the present invention relates to a keyboard guitar having a limited number of keys and an extended neck including functional transpose buttons.

Keyboard guitars provide a greater range of movement compared to a traditional keyboard. Rather than being confined to standing or sitting behind a stationary instrument, a keyboard guitar player is free to roam the stage. However, keyboard guitars still suffer from many drawbacks, which slow their adoption as a popular musical instrument.

Many keyboard guitars resemble keyboards more than guitars. Indeed, many keyboard guitars are little more than portable keyboards with short necks. This leads to a style of play that is more keyboard-like than guitar-like, both physically and musically. Further, while guitars have a pleasing aesthetic that is very popular amongst musicians, keyboard guitars often have a very unpleasing aesthetic that hurts their desirability as instruments regardless of a keyboard guitar's musical expressivity. Additionally, keyboard guitars have had limited functionality to enable the player to utilize popular musical techniques to enhance their musical expressivity when compared to the guitar, such as, for example, note bending, hammer-ons, pull-offs, tremolo, etc.

Accordingly, there is a need for a keyboard guitar that enables the user to experience a more guitar-like style of play that preserves the aesthetic of a guitar and provides the player the ability to use techniques that have the expressivity of a guitar, as described herein.

BRIEF SUMMARY OF THE INVENTION

To meet the needs described above and others, the present disclosure provides a keyboard guitar that enables the user to experience a more guitar-like style of play that preserves the aesthetic of a guitar and provides the player the ability to use techniques that have the expressivity of a guitar.

By providing a keyboard guitar having a limited number of keys and an extended neck including transpose buttons to control tuning, the current invention provides a keyboard guitar having a more guitar-like design and style of play. Further, by providing for transpose buttons capable of bending a note, the current invention provides a keyboard guitar with techniques that have the expressivity of a guitar. Additional controls allowing for greater tone control and flexibility provided herein only further enhance the functionality of the keyboard guitar.

In one example, the keyboard guitar includes a body, substantially shaped like guitar body, containing a keybed having a plurality of keys; and a fretboard, substantially shaped like a guitar fretboard, connected to the body and having a plurality of transpose buttons, wherein the transpose buttons of the fretboard are configured to control the tuning of the keybed. By pressing the appropriate transpose button of the fretboard, a player may make an instantaneous change to the desired key.

In a further example, the transpose buttons of the fretboard may be manipulated to vary the pitch of a note being played, known as "bending the note."

In yet another example, the neck may include a touch sensitive surface, for example a touch controller, disposed along the top or the bottom of the neck. The touch controller may be configured to control the tuning of the keybed and to permit the player to vary the pitch of a note being played by dragging a finger along the touch sensitive surface.

As an additional example, the keys of the keyboard may be maneuvered side-to-side while being pressed to create a tremolo effect.

In one example, a musical instrument includes: a body including a keybed having a plurality of keys, wherein activation of each key creates an electrical signal at an output, wherein said electrical signal represents a pitch associated with a musical note; an elongated neck connected to the body; and a plurality of transpose buttons located along the length of the neck, wherein the transpose buttons of the fretboard are configured to control the tuning of the keys in the keybed such that activation of each of the transpose button alters the pitch represented by the electrical signal that is output by of each of the keys.

The neck may include at least twelve transpose buttons, each associated with a distinct key from the traditional Western music scale. The transpose buttons may be physically manipulated to alter the pitch represented by the electrical signal for each key. The elongated neck may further include a touch sensitive surface configured such that a user may alter the pitch represented by the electrical signal that is output by of each of the keys by dragging a finger along the touch sensitive surface. The body and neck may be in the shape of an electric guitar. Each transpose button may be one half step up in tuning from a first adjacent transpose button and one half step down in tuning from a second adjacent transpose button.

An advantage of the invention is that changing chords is as simple as playing one chord on the keys and switching between transpose buttons with the fretting hand.

A further advantage of the invention is that it can be played standing up using a strap around the shoulder and neck to hold the instrument, or sitting down with the keyboard guitar across the lap of the keyboard guitar player.

A further advantage of the invention is that fewer keys are needed on the instrument body because the transpose buttons and octave up and octave down buttons add many more octaves thus allowing for a full range of keys. In doing so, the keyboard guitar is able to take on a more appealing "guitar-like" look, as traditional keyboard guitars have the reputation for looking more like keyboards.

A further advantage of the invention is providing improved musical expressiveness due to the function of the transpose buttons providing the capability of varying the tuning of the keyboard and varying the pitch of a note being played.

A further advantage of the invention is keys that make a tremolo provide the player with a greater range of expressiveness in playing.

A further advantage of the invention is a keybed that is replaceable, to allow the player more options and to suit player preferences, such as being flipped around to accommodate left handed players.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
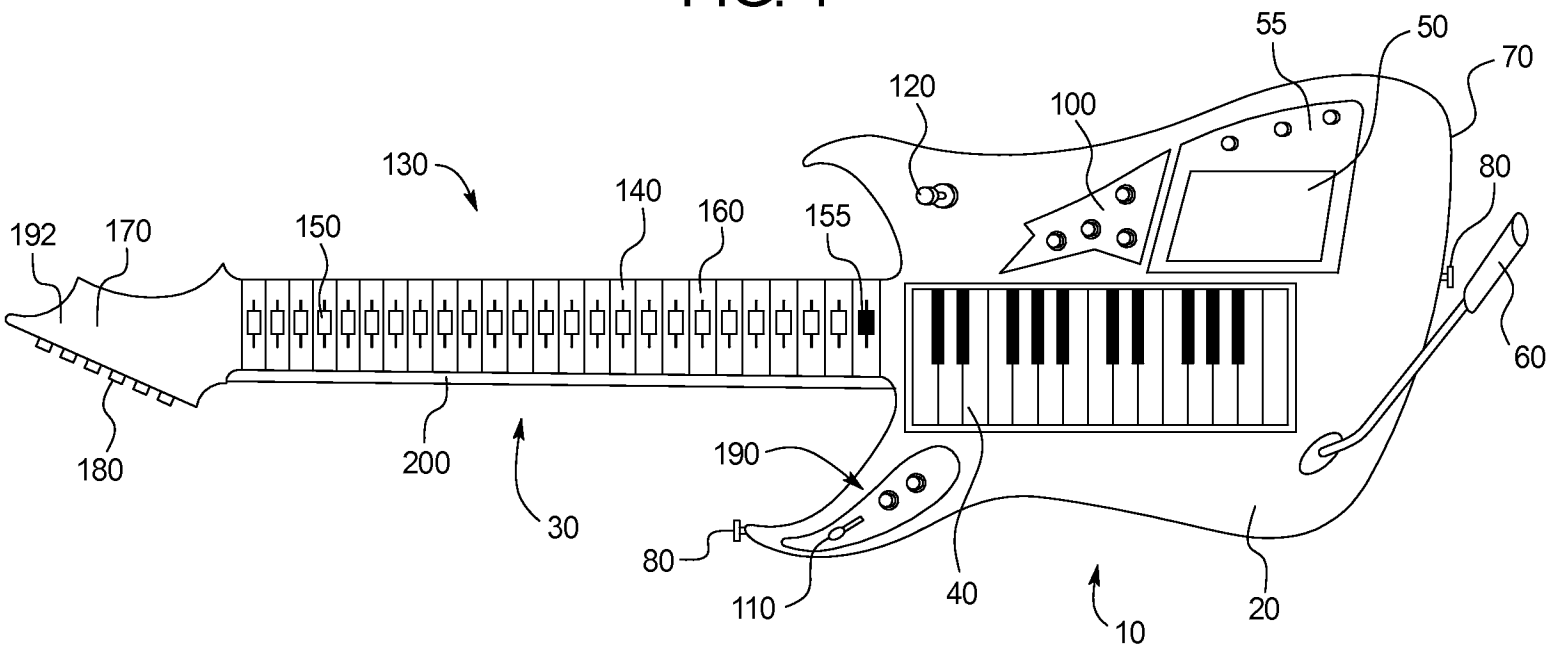
FIG. 1 is a front view of the keyboard guitar according to the present invention.

FIG. 1 illustrates an example of a keyboard guitar 10. FIG. 1 is merely one example of the shape and form a keyboard guitar 10 may take using the teachings provided herein. It is understood that there are numerous shapes and forms that may be used to embody the solutions provided by the present disclosure, as will be understood by those skilled in the art based on the descriptions provided herein. It is expected that many changes to the physical shape of the keyboard guitar 10 may be made to match the stylistic preferences of players.

As shown in FIG. 1, the keyboard guitar 10 includes a body 20 and neck 30. The body 20 includes a keybed 40, a control screen 50, a whammy bar 60, a cable jack 70. The body 20 may also include shoulder strap mounts 80, tone knobs 100, a tone switch 110, a pitch bender or tremolo joystick 120, and octave up and octave down buttons 190. The neck 30 includes a fretboard 130 having a plurality of frets spaces 140. Each fret space 140 includes a transpose button 150 and a note indicator 160. The neck 30 may further include a neck pitch bender 155 to provide an alternative control to bend the pitch. The neck 30 optionally includes a touch controller 200 that runs along one side of the fretboard 130. The transpose buttons 150 are positioned in or near the center of the neck 30 running lengthways and are separated into frets spaces 140 by vertical lines mimicking the frets of a guitar. The neck 30 also includes a headstock 170. The headstock 170 includes a plurality of control knobs 180 and second set of octave up and down buttons 192.

In the example shown, the keybed 40 provides two octaves of keys. Alternatively, the keybed 40 may provide a greater or lesser number of keys. Further, the keys may be provided in different sizes and/or there may be multiple rows of keys provided in the keybed 40. In a preferred embodiment, the keybed 40 may be attached to the body 20 by screws and to the electronics via a wire harness, thus making the keybed 40 removable and allowing for the use of alternative keybeds 40. Alternative keybeds 40 may include keybeds 40 with varied configurations and may include keybeds 40 with varied tactile responsiveness, such as keybeds 40 with different resistance (i.e., play) of the keys. Alternative keybeds 40 may come in a variety of designs and colors, permitting the design and color of the keybed 40 to match/coordinate/compliment the color and design of the body 20 of the keyboard guitar 10. The keybed 40 may also be reversible allowing the keybed 40 to be flipped around to accommodate left handed players. In one contemplated embodiment, the keybed 40 may have keys that make a tremolo effect when pressed and maneuvered (i.e., wiggled) side to side. Accordingly, in addition to the sensors used in a typical keybed 40 that react to varying key strikes, one or more additional sensors may be adapted to respond to the movement of the keys in a plane approximately ninety degrees from a traditional key strike.

As shown, each fret space 140 includes an associated transpose button 150, and an associated note indicator 160. The note indicator 160 may be a plurality of small LED lights that activate when the transpose button 150 is pressed or moved. Alternatively, the note indicator 160 may be a small screen display. The note indicator 160 may show the current tuning of the fret space 140. While described as LED lights or a display screen, it is understood that variations of the display may be used, as will be recognized by those skilled in the art based on the disclosure provided herein.

As shown in the example provided in FIG. 1, the transpose buttons 150 run the length of the fretboard 130. While shown with a specific form, the transpose buttons 150 can be formed in any shape and from any material appropriate for the functions described herein. In one embodiment, the transpose buttons 150 are formed with minimal topological relief (i.e., minimal peaks and valleys between the transpose buttons 150 and the fretboard 130), which improves the player's ability to slide across the notes (i.e., transpose buttons 150) similar to a guitar player's slide up or down a guitar's fretboard. It is contemplated that the transpose buttons 150 can be formed in any shape and from any material appropriate to allow heavy playing without fear of breaking the transpose buttons 150 and/or the transpose buttons 150 should be easily replaceable if broken. For example, transpose buttons 150 can be made of smooth, strong plastic material that is smoothly tapered on all sides. Of course, numerous known material and shape substitutes may be used, as will be recognized by those skilled in the art.

In the standard setting mode, the transpose buttons 150 may control the tuning of the keys of the keybed 40. For example, when the player presses, or otherwise activates, a transpose button 150, the tuning of each of the keys may change. In the example shown, each transpose button 150 is ½ step up in tuning from the one above it or ½ step down in tuning from the one below it. Thus, using the standard issue middle C keybed 40 with the instrument and no transpose buttons 150 are active, or with a designated "middle C" transpose button 150 active, the keys may be tuned to A 440 (i.e., standard tuning). If the player were to activate the top fret button 150, or the fret button 150 just below a designated middle C transpose button 150, all of the keys in the keybed 40 may go up in tuning ½ step; causing the middle C key in the keybed 40 to sound like the note C# (i.e., C-4sharp).

In some embodiments, the transpose buttons 150 may be adapted to also control the pitch of each note played on the keys. For example, each transpose button 150 may be adapted to slide along the width of the neck 30 to bend the note being played on the keys either up or down. In the standard setting mode, as the transpose button 150 is slid one direction across the neck, the note may "bend" up in pitch. As the transpose button 150 is slid in the opposite direction across the neck 30, the note may "bend" down in pitch. In a preferred embodiment, each transpose button 150 may be adapted to bend a note up to a max of two half steps. The direction in which the transpose buttons 150 translate to bend a note up or down in pitch may be reversed and the magnitude of the bend may be adjusted to meet the preferences of players. Such parameters may be controlled, for example, through settings adjusted via the control screen 50.

To accomplish the note bending functionality, the each transpose button 150 may be mounted via one or more springs adapted to bias the transpose button 150 to its starting position (i.e., neutral position) upon release. The spring tension may be stiff so the transpose button 150 will not slide unintentionally. While a spring-loaded transpose button 150 is one example of a biasing mechanism that enables a transpose button 150 to perform as described, it is recognized that there are numerous mechanisms that may be used to accomplish the functions described herein, as will be recognized by those skilled in the art based on the disclosure provided.

The neck 30 of the keyboard guitar 10 optionally includes a touch controller 200 that runs along the length of the neck 30. The touch controller 200 may be touch sensitive, for example it may be a capacitive touch sensor. The touch controller 200 may be used during play to transpose notes, depending on the direction the player moves his or her finger that is touching the touch controller 200. For example, the player may slide his or her finger up or down the length of the touch controller 200, shifting the pitch of the note being played, similar to the way a guitar player would slide his or her finger up or down a guitar string. As with other elements of the keyboard guitar 10, a player may alter the behavior of the touch controller 200 by changing settings though the control screen 50. For example additional and/or alternate effects may be triggered by the touch controller 200. While shown with a single touch controller 200, alternatively, the keyboard guitar 10 may include two touch controllers 200, one on each side of the neck 30, to permit ease of access or increased play options.

Extending the concept of the touch controller 200, the entire fretboard 130 may be a touch controller 200. In such an embodiment, the fret spaces 140, transpose buttons 150, and note indicators 160 may be virtually presented and controlled on the touch touch controller 200. In such embodiments, the touch controller 200 may be a capacitive touch screen that displays virtual fret spaces 140, transpose buttons 150, and note indicators 160. The virtual fret spaces 140, transpose buttons 150, and note indicators 160 may operate as described above, including the vibrato and sliding functionality. The touch controller 200 may also be pressure sensitive and permit the playing of additional effects. Again, the settings of the touch controller 200 may be adjusted via the control screen 50.

Modifying various settings may adjust the behavior of the keyboard guitar 10. For example, the tuning at rest (i.e., default tuning) may be set and adjusted by a setting. Another setting may determine, when a transpose button 150 is activated and then released, whether the instrument holds the tuning until another transpose button 150 is activated, or whether the tuning reverts back to the default tuning when released. The settings for the transpose buttons 150 may also be changed, as a group or individually, to provide for alternate tunings. For example, a setting may be adjusted such that when in the default tuning, the transpose button 150 that would normally represent middle C is set to a middle D, such that when this transpose button 150 is activated, the keys on the keybed 40 are transposed up in tuning one full step. To better aid the player's understanding of the present configuration of the keyboard guitar 10, the note indicators 160 may be adapted to show the current tuning of the transpose button 150.

The knobs 100 on the body 20 may be positioned approximately consistent with the placement of similar knobs on a guitar and may be used to control various audio settings, such as tone, volume, reverb, and chorus. Changing settings through the control screen 50 may modify the function of the knobs 100. The pitch bender or tremolo joystick 120 may be a wheel or joystick and may be used for bending notes or tremolo, depending on the settings chosen through the control screen 50. As shown, the pitch bender or tremolo joystick 120 may be positioned on the lower part of the body 20 so that the left fretting hand can easily reach it from underneath the keyboard guitar 10. Similarly, the tone switch 110 may be positioned consistent with the placement of a tone switch on a guitar and may be used to change various audio settings, such as weighting the overall tonal response to the bass or treble side. In a preferred embodiment, the tone switch 110 may have five different positions like that of an electric guitar pickup switch, mimicking the selection of various pickup configurations. The function of the tone switch 110 may be modified by changing settings through the control screen 50.

The whammy bar 60 is a long metal bar attached to the keyboard guitar 10 body 20. The whammy bar 60 may be positioned as shown adjacent to the keybed 40 or at any alternative position that permits the player easy access. The whammy bar 60 may be configured to be unscrewed and removed or moved to alternative positions. As with the other tonal controls, the function of the whammy bar 60 may be modified by changing settings through the control screen 50. For example, the sensitivity of the whammy bar 60 may be adjusted through the control screen 50.

In the example shown in FIG. 1, the keyboard guitar 10 includes two sets of octave up and down buttons: first octave up and down buttons 190; and second octave up and down buttons 192. The octave up and down buttons 190 and 192 may be configured to control the octave to which the transpose buttons 150 of the fretboard 130 correspond. For example, by pressing the octave up button, the transpose button 150 corresponding to middle C by default, may be adjusted to correspond to the C one octave above middle C. The octave up and down buttons 190 and 192 are shown to be placed near the fretboard 130 on both the side of the body 20 and the headstock 170 to provide easy access while playing either high or low on the fretboard 130. The function of the octave up and down buttons 190 and 192 may be modified by changing settings through the control screen 50.

A plurality of control knobs 180 are shown to be included on the head 170. The control knobs may be configured to permit adjustment of various sound parameters, such as will be recognized by those skilled in the art based on the disclosure provided herein. The function of the plurality of control knobs 180 may be modified by changing settings through the control screen 50.

As described above, numerous aspects of the keyboard guitar 10 may be adjusted through the control screen 50. As shown in FIG. 1, the control screen 50 may be configured to display information about the current settings and state of the keyboard guitar 10. The control screen 50 may be an LCD screen, plasma screen, or other display capable of being incorporated into the keyboard guitar 10 and may further include associated control buttons 55. The control screen 50 may be a capacitive touch screen to permit the user to input settings directly through the control screen 50, rather than through the associated control buttons 55.

The cable jack 70 may be configured to receive a standard instrument cable to connect the keyboard guitar 10 to an amp/rack module. In an alternative embodiment, the cable jack 70 may allow for connection with a non-standard instrument cable in order to transmit the instrument signal and to provide power to the keyboard guitar 10. Alternatively, multiple cable jacks 70 may be provided to separate a cable carrying power from a cable carrying the instrument signal. In that configuration, the multiple cable jacks 70 may be positioned close together so that multiple cables can stay together either in a single jacket or tied together with hook and loop fastener straps. In another alternative, the keyboard guitar 10 may be configured to run on batteries, eliminating the need for a power cable. In a further alternative, the keyboard guitar 10 may be configured to transmit the instrument signal wirelessly.

Figure 2:
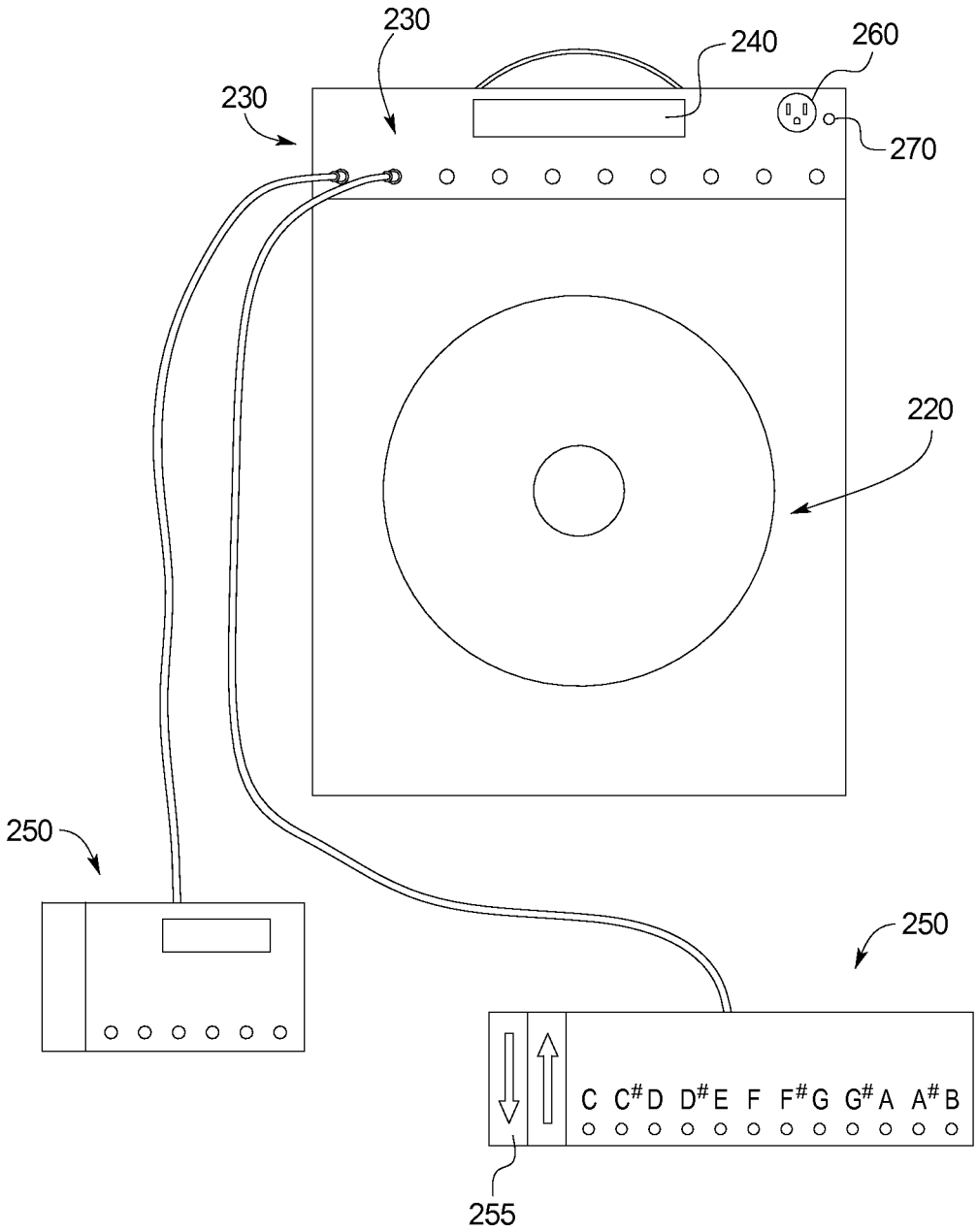
FIG. 2 is a front view of a rack module, speaker cabinet, and foot-operated controllers for use with a keyboard guitar such as the one shown in FIG. 1.

As shown in FIG. 2, the keyboard guitar 10 may be configured to interoperate with a custom rack module 210. The rack module 210 may receive the instrument signal for further processing and may be amplified to drive a speaker cabinet 220. For example, the rack module 210 may be configured to be used with a standard guitar amp and sized to fit in a standard guitar rack. The rack module 210 may have knobs, buttons, and/or other controls 230 for adjusting sound, changing settings, and for controlling a backlit display 240. The display 240 may show settings, display the current state of the rack module 210 and/or keyboard guitar 10, program sounds or effects, and may be optionally controlled by one or more foot-operated controllers 250. The rack module 210 may include a power receptacle 260 to receive a power cable to power the keyboard guitar 10 and may have an instrument jack 270 to receive an instrument cable carrying the instrument signal. The power receptacle 260 and the instrument jack 270 may be positioned adjacent to each other to permit the power cable and the instrument cable to be tied together or assembled in a single jacket.

As shown in FIG. 2, the keyboard guitar 10 may be adapted to interoperate with a various foot-operated controllers 250. One example is a transpose controller 250 that may allow for the player to transpose the keys or change octaves by pressing the foot switches 255 instead of using the transpose buttons 150 to permit the player to use both hands while playing the keys on the keybed 40. The transpose controller 250 may connect to the rack module 210 by cable. Similarly, the keyboard guitar 10 may be configured to interoperate with additional foot-operated controllers 250, including various foot switches or effects pedals. The foot switches or effect pedals may allow for the player to program sounds and effects controlled by the rack module 210. The foot switches or effect pedals connect to the rack module 210 by cable.

It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A musical instrument comprising:

a body including a keybed having a plurality of keys, wherein activation of each key creates an electrical signal at an output, wherein said electrical signal represents a pitch associated with a musical note;

an elongated neck connected to the body; and a plurality of transpose buttons located along the length of the neck, wherein the transpose buttons of the fretboard are configured to control the tuning of the keys in the keybed such that activation of each of the transpose button alters the pitch represented by the electrical signal that is output by of each of the keys.

2. The musical instrument of claim 1 wherein the neck includes at least twelve transpose buttons, each associated with a distinct key from the traditional Western music scale.

3. The musical instrument of claim 1 wherein the transpose buttons may be physically manipulated to alter the pitch represented by the electrical signal for each key.

4. The musical instrument of claim 1 wherein the elongated neck further includes a touch sensitive surface configured such that a user may alter the pitch represented by the electrical signal that is output by of each of the keys by dragging a finger along the touch sensitive surface.

5. The musical instrument of claim 1 wherein the body and neck are in the shape of an electric guitar.

6. The musical instrument of claim 1 wherein a transpose button is one half step up in tuning from a first adjacent transpose button and one half step down in tuning from a second adjacent transpose button.

* * * * *